US010898012B2

(12) United States Patent
Green

(10) Patent No.: US 10,898,012 B2
(45) Date of Patent: Jan. 26, 2021

(54) REFRIGERATED DISPLAY CASE AND NIGHT COVER THEREFOR

(71) Applicant: Thermasolutions International Limited, Northamptonshire (GB)

(72) Inventor: Colin Green, London (GB)

(73) Assignee: Thermasolutions International Ltd, Northamptonshire (GB)

( * ) Notice: Subject to any disclaimer, the term of this patent is extended or adjusted under 35 U.S.C. 154(b) by 0 days.

(21) Appl. No.: 16/070,487

(22) PCT Filed: Feb. 2, 2018

(86) PCT No.: PCT/GB2018/050310
§ 371 (c)(1),
(2) Date: Jul. 16, 2018

(87) PCT Pub. No.: WO2018/142155
PCT Pub. Date: Aug. 9, 2018

(65) Prior Publication Data

US 2019/0357698 A1 Nov. 28, 2019

(30) Foreign Application Priority Data

Feb. 3, 2017 (WO) ..... PCT/EP2017/052384
Jun. 5, 2017 (GB) ..... 1708931.9
Nov. 24, 2017 (GB) ..... 1719553.8

(51) Int. Cl.
*A47F 3/04* (2006.01)

(52) U.S. Cl.
CPC ..... *A47F 3/0443* (2013.01); *A47F 3/043* (2013.01); *A47F 3/0469* (2013.01)

(58) Field of Classification Search
CPC ..... A47F 3/043; A47F 3/0439; A47F 3/0443; A47F 3/0469
(Continued)

(56) References Cited

U.S. PATENT DOCUMENTS 4,313,485 A * 2/1982 Gidge ..... A47F 3/0469 160/328
5,429,404 A * 7/1995 King, Sr. ..... B60J 5/0487 160/349.1
(Continued)

FOREIGN PATENT DOCUMENTS

DE 29804329 U1 5/1998
EP 0630601 A1 12/1994
(Continued)

*Primary Examiner* — James O Hansen
(74) *Attorney, Agent, or Firm* — Oppenhuizen Law PLC; David L. Oppenhuizen

(57) ABSTRACT

A refrigerated display case 1 of the open front type has a roller mounted night cover 51 formed of flexible material which, in a deployed position, is arranged to close the front opening of the display case. The flexible material of the night cover has a plurality of apertures 54 arranged in a first section 51 that are disposed in an upper 30%-40% of the front opening. The apertures have a constant diameter D, chosen to be a fixed dimension in the range 9 mm-11 mm, that are arranged in a vertical and a horizontal grid. The spacing between the aperture centres in the vertical direction y of the grid is 3D and the spacing between aperture centres in the horizontal direction x of the grid is in the range 2D to 4D, preferably 3D. The specific dimensions of the first section and of the apertures and their grid arrangement is arranged to eliminate hotspots and improve the efficiency of the refrigeration system.

16 Claims, 11 Drawing Sheets

Figure 1:
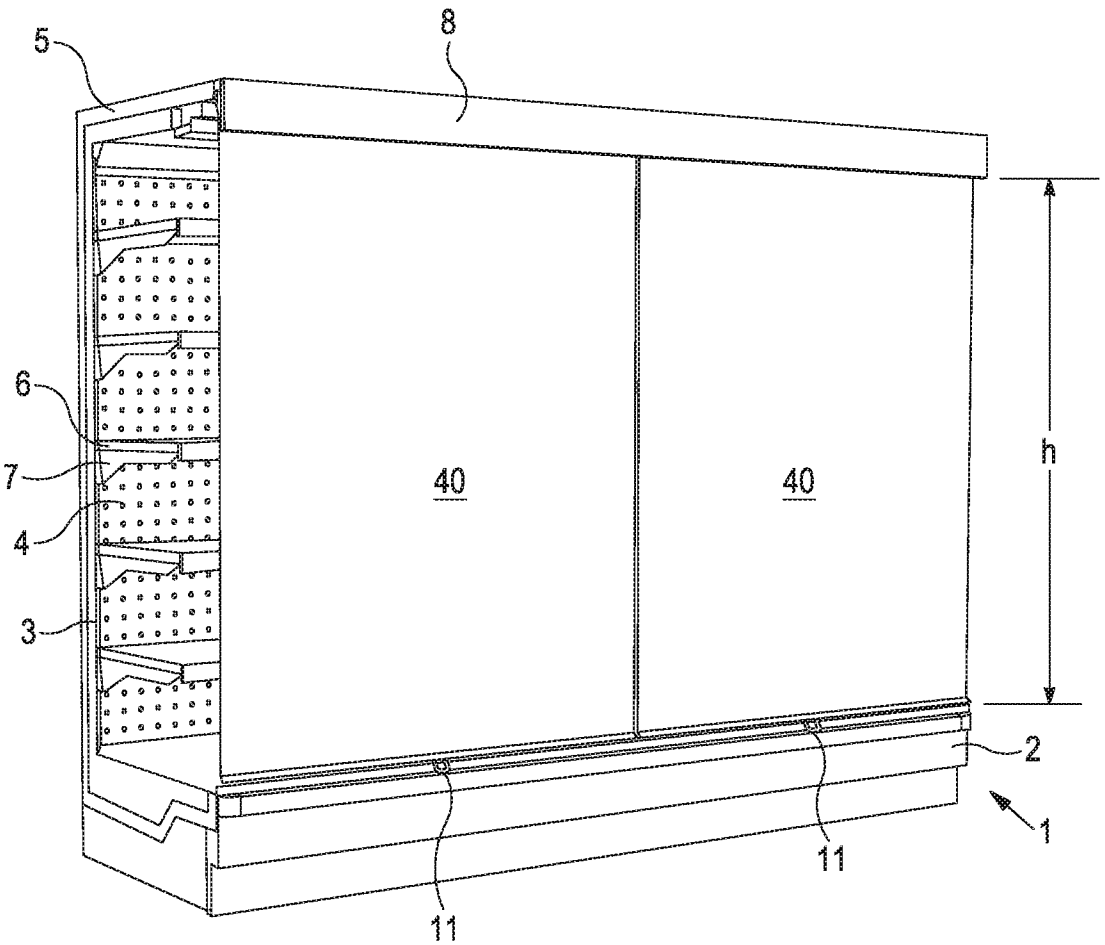
PRIOR ART FIG. 1

(58) Field of Classification Search
USPC ..... 312/116
See application file for complete search history.

(56) References Cited

U.S. PATENT DOCUMENTS

| | | | | |
|---|---|---|---|---|
| 2015/0087221 | A1* | 3/2015 | Nguyen | A47F 3/0469 454/275 |
| 2015/0366373 | A1* | 12/2015 | Kim | A47F 3/0469 62/249 |

FOREIGN PATENT DOCUMENTS

| | | | |
|---|---|---|---|
| EP | 2850977 | A1 | 3/2015 |
| GB | 2087529 | A | 5/1982 |
| JP | S57166085 | A | 10/1982 |
| JP | S57166085 | U | 10/1982 |
| JP | H10272041 | A | 10/1998 |
| JP | 2016069991 | A | 5/2016 |
| WO | 2005074757 | A1 | 8/2005 |

* cited by examiner

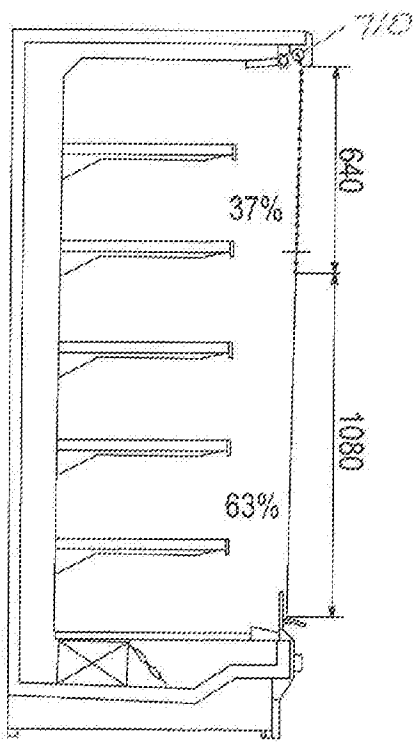
FIG. 7a
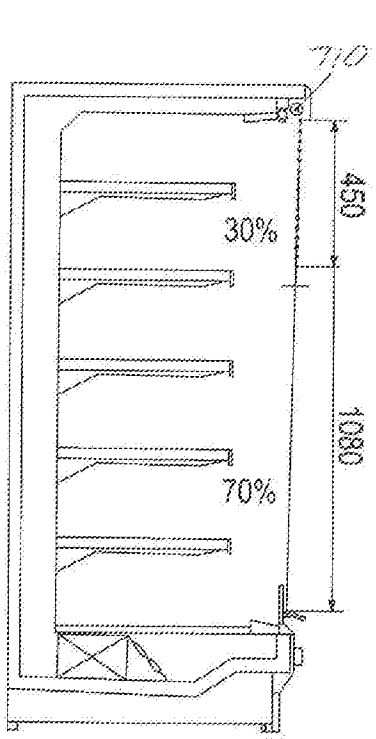
FIG. 7b
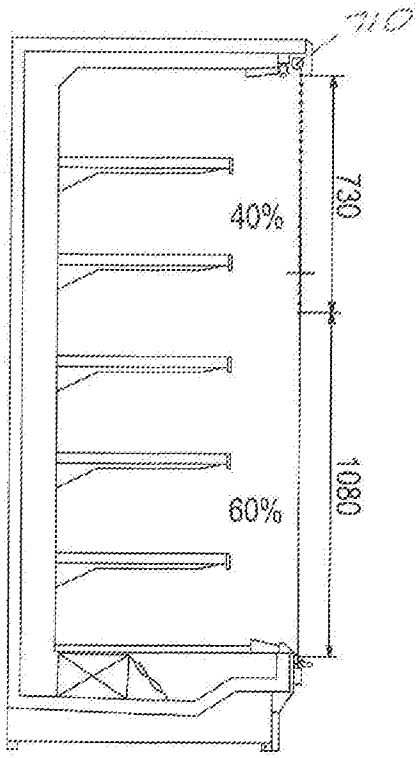
FIG. 7c
FIG. 7d

REFRIGERATED DISPLAY CASE AND NIGHT COVER THEREFOR

This is a National Stage of International Application No. PCT/GB2018/050310, filed Feb. 2, 2018, which claims the priority of British Application No. 1719553.8 filed Nov. 24, 2017, British Application No. 1708931.9 filed Jun. 5, 2017, and International Application No. PCT/EP2017/052384 filed Feb. 3, 2017, the entire disclosures of which are hereby incorporated by reference in their entirety.

This invention relates to a refrigerated display case of the type having an open front and to a night cover therefor.

Refrigerated display cases of the open front type have a product display area where products are supported on shelves to be visible and accessible through an opening at the front of the case. Such display cases are used in, for example supermarkets and grocery stores, where consumables, such as food or drink, are to be held in a refrigerated condition.

The refrigeration system includes a compressor, a condenser and an evaporator which cools air that is pumped from a base of the display case up a rear channel, along a top panel toward the front of the display case where the air forms a cooling air curtain that is blown downwardly over the open front surface of the display case to be returned to the compressor for re-processing and re-circulation.

In order to reduce energy consumption it is known to fit such refrigerated display cases with a night cover formed by a retractable blind, for example a roller blind, in which fabric of the blind material may be deployed and re-deployed to a roller. Where the roller is manually deployed, so the roller is biased by a tension spring so that the blind is deployed against the bias of the tension spring and re-wound, i.e. re-deployed, by virtue of the tension of the spring. Alternatively, the blind may be deployed and re-deployed by an electric motor actuating the roller.

The night cover is typically deployed at night to cover the open front of the display case to reduce heat ingress into the case and thereby reduce the load on the refrigeration system to reduce the amount of energy consumed. The night cover material may be that produced by Lenzing Plastics part number 7704284 if unperforated or 77048572 if perforated, or, preferably, a low emissivity aluminized polyethylene or polyester cross-weave fabric part number 77026928 for a perforated fabric or part number 77026929 for a non-perforated fabric. A perforated fabric having perforations of 1 mm or less is often preferred to reduce condensation on product in the display case.

In a known open fronted multi-shelf display case, the known night cover may reduce energy consumption over an eight-hour period from a typical 14.4 kWh to a typical 9.6 kWh—an energy saving of up to one third.

EP-A-0630601 discloses a refrigerated display case having a night cover (blind). As stated in this application, due to constraints on the design and construction of the display case, the night cover blind is not guided or otherwise held tight against and along the two opposed vertical sides of the case. Thus, a gap between the vertical sides of the blind and the case occurs when the blind is deployed, and where two adjacent blinds are used there is a gap between the adjacent edges of the blinds. Warmer, moisture-laden air, ingresses around these gaps releasing content in the form of condensate onto products on the shelves of the display case and, on account of this, the shelves and products are found to be wet upon removal/re-deployment of the covering blind(s). This application also states that an outflow of denser cold air takes place from a lower portion of the display case and a corresponding inflow of warm air takes place into the upper portion of the display case. In order to limit the velocity of the air inflow, the solution proposed by this application is to promote non-turbulent circulation of ambient air between the cold air barrier, i.e. cold air curtain, and the night cover (blind) by utilising a plurality of rectangular apertures in rows in an upper portion of the night cover so as to slow down air flowing through the night cover and through the gaps between the night cover and the sides of the display case. Thus, the problem to be solved by this reference is the elimination of condensation within the display case.

EP-A-2850977 also discloses a display case having a night cover. This reference acknowledges that the ingress of ambient air into the product display area of the display case penetrates the cold air curtain and increases product temperatures in the case. This reference also discloses apertures in the night cover which are arrayed in an upper portion of the night cover, wherein the apertured section of the night cover has a surface area of between 1 to 7 and 1 to 18 of the non-apertured area. The apertures are stated to be between 38 mm-44 mm in diameter or width, and in one embodiment the apertures are arranged to be two different diameters with the uppermost row of apertures being smaller than the lowermost row of apertures.

The larger diameter apertures of EP-A-0630601 and EP-A-2850977 have been found in experimentation to provide too high a desired velocity of air ingress and not a smooth spread of air ingress across the whole of the apertured section of the night cover resulting in perturbation of the air curtain. It has also been found that the larger apertures weaken the night cover, leading to distortion of the night cover.

Despite previous attempts to overcome problems associated with night covers, the present inventor has identified a problem of hot spots occurring from around a mid-point in height of a display case at locations on the shelves of the display case leading to a sometimes undesirable rise in temperature of product stored on the shelves, and these hot spots tend to be around the upper vertical edges of the night blind due to the ingress of ambient air. The production of these hot spots also tends to increase the power consumption of the refrigeration system to try and maintain the temperature within the display case stable.

The present invention seeks to at least partially mitigate the foregoing problems.

According to a one aspect of this invention there is provided a refrigerated display case having a front opening and a roller mounted night cover formed of flexible material, said night cover being arranged to be in a non-deployed position when the refrigeration display case front opening is to be substantially open, and when in a deployed position said night cover is arranged to substantially close said front opening, said flexible material having a plurality of apertures therein arranged in an upper first section having a range of heights extending from a top of the display case front opening down to 30%-40% of said front opening, said apertures having a constant diameter D chosen to be a fixed dimension in the range 9 mm-11 mm and being arranged in a vertical and a horizontal grid, the spacing between said aperture centres in the vertical direction of said grid being 3D and the spacing between aperture centres in the horizontal direction of said grid being in the range 2D to 4D, and a lower second section which is unapertured.

The present inventor, after several years of experimentation, has found that such a selection of size and spacing of aperture and location of the apertures within the opening substantially eliminates hotspots and improves the efficiency of the refrigeration system leading to lower power consumption, i.e. improving power economy.

The apertures are sized and spaced to permit ambient air to flow therethrough to substantially prevent hotspots occurring in the refrigeration display case, whereby air lost from the refrigeration display case is substantially compensated without breaching the normally provided air curtain in the refrigerated display case.

In one preferred embodiment, the apertures are arranged in the night cover to be in an upper one third of the display case opening.

Advantageously, the diameter D of the apertures is 10 mm.

Advantageously, the spacing of the aperture centres in the horizontal direction of said grid is 3D.

Advantageously, the night cover has a further section without apertures extending from a top edge of the night cover to 10% of the length of the first and second sections, wherein the further section is wound around said roller.

Conveniently, in a manual version of the night cover, the lowermost end thereof is attached to a handle for deploying the night cover and, conveniently, said handle has a hook for securing the night cover to a base of the refrigerated display case.

Alternatively, the lowermost end of the night cover forms an envelope within which is located a magnetic strip for securing the night cover when deployed to a base of the refrigerated case.

In another embodiment, the roller is electrically operated to deploy and rewind the night cover.

According to another aspect of this invention there is provided a night cover for covering an opening in a front of a refrigerated display case, said night cover being made from a flexible material having a height h1, a plurality of apertures in an upper first section having a range of heights a which is 30%-40% of said height h1, said apertures having a constant diameter D chosen to be a fixed dimension in the range 9 mm-11 mm and arranged in a vertical and horizontal grid, the spacing between said aperture centres in the vertical direction of said grid being 3D, and the spacing between aperture centres in the horizontal direction of said grid being chosen to be in the range 2D to 4D, and a lower second section which is unapertured.

Advantageously, height a is one of one third of h1, 30% of h, 40% of h1 and 37% of h1.

Preferably the night cover has a further section without apertures extending from a top edge of the first section to 10% of height h1, wherein the further section is arranged to be wound around a roller.

Advantageously, for a one metre wide night cover the percentage of aperture area to unapertured area ranges between 2.6% for a 450 mm high night cover to 4.2% for a 870 mm high night cover.

Figure 2C:
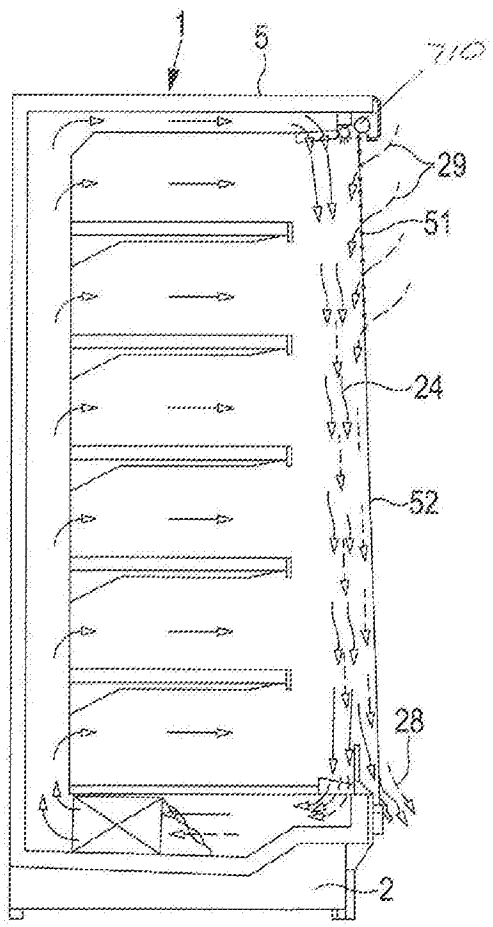
FIG. 2c PRIOR ART
Figure 2B:
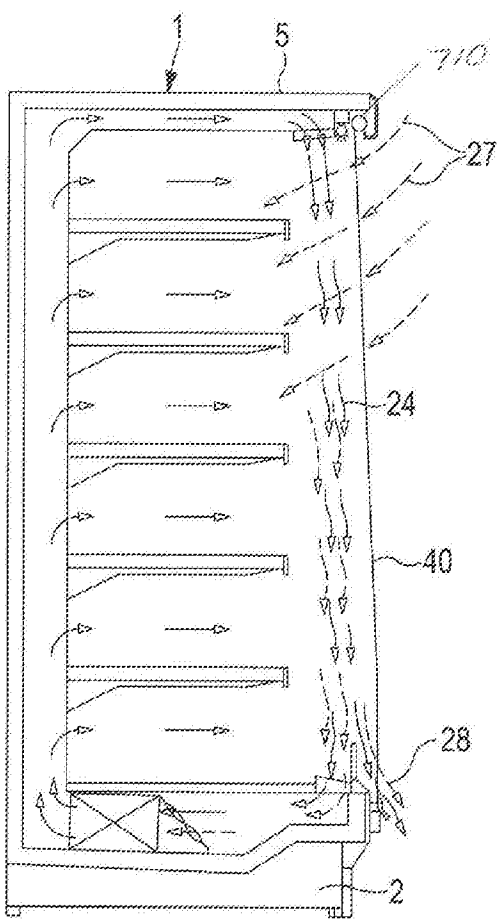
FIG. 2b PRIOR ART
Figure 2A:
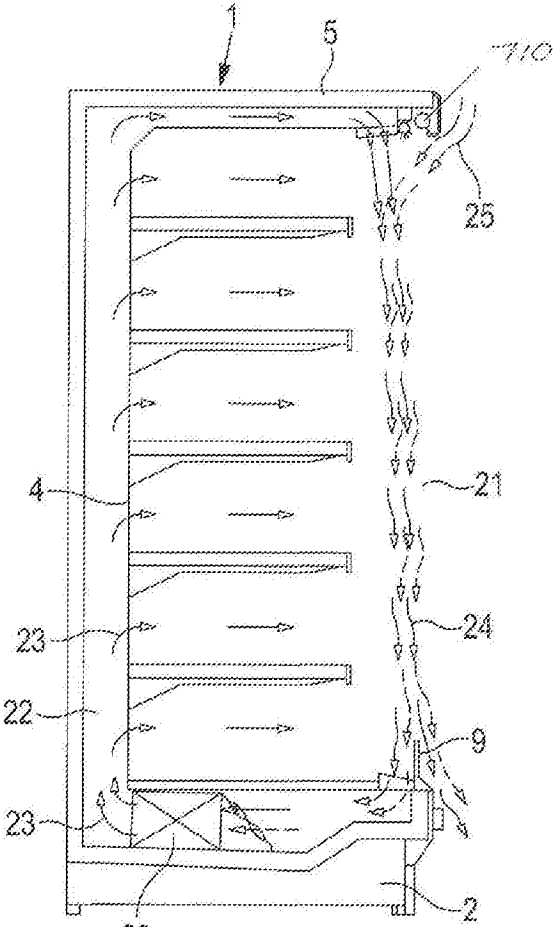
FIG. 2a PRIOR ART
Figure 3A:
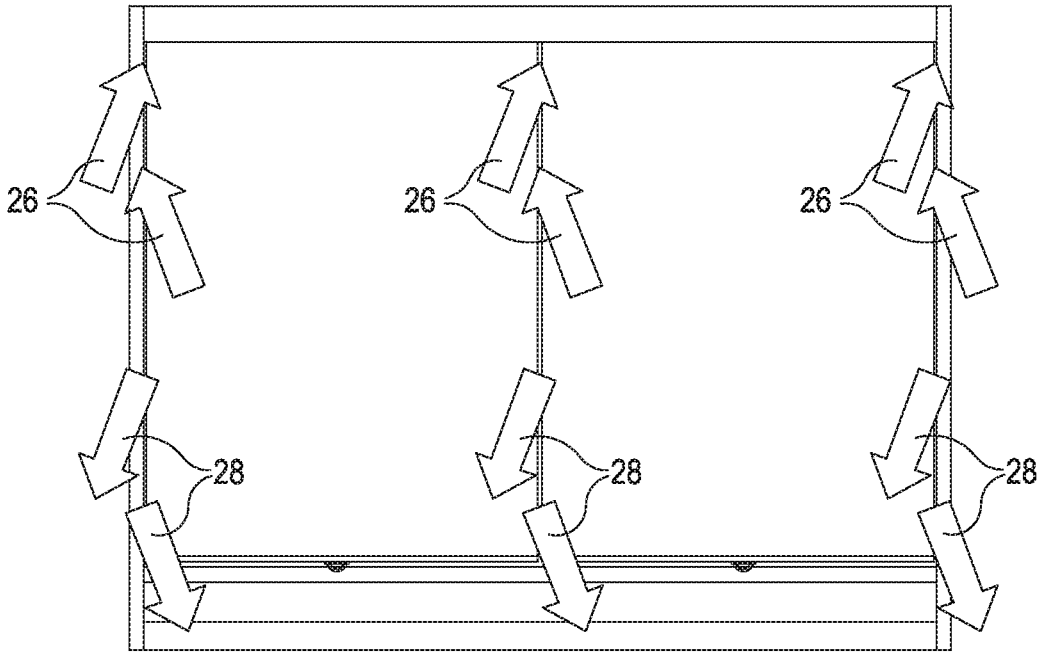
FIG. 3a PRIOR ART
Figure 3B:
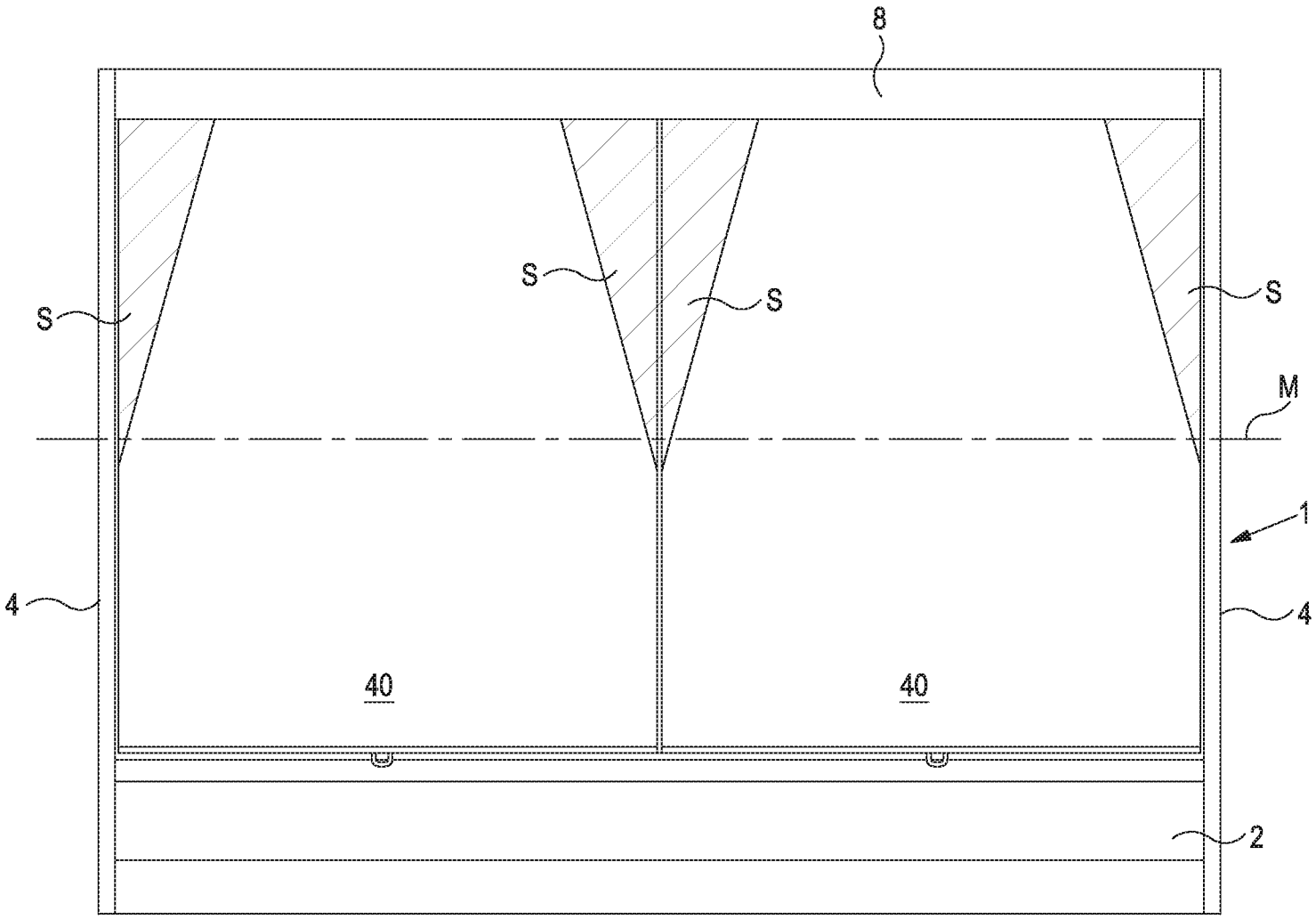
FIG. 3b PRIOR ART
Figure 3C:
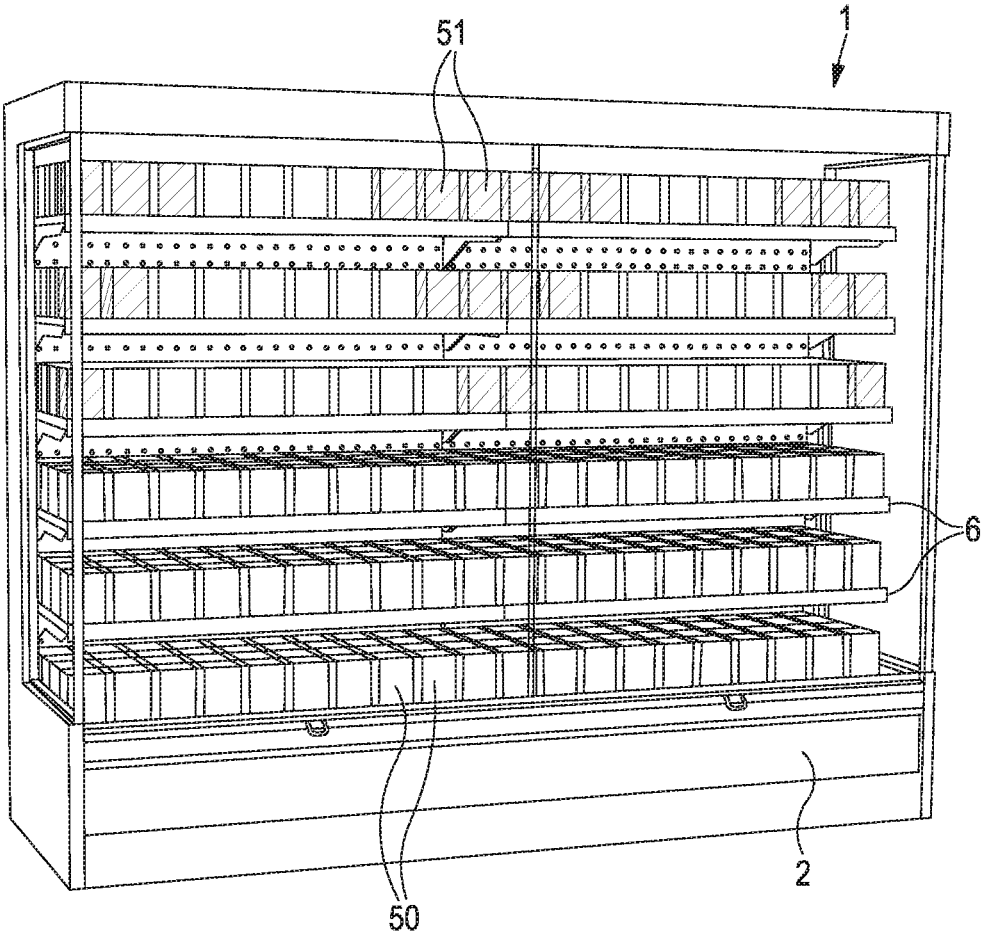
FIG. 3c PRIOR ART
Figure 4:
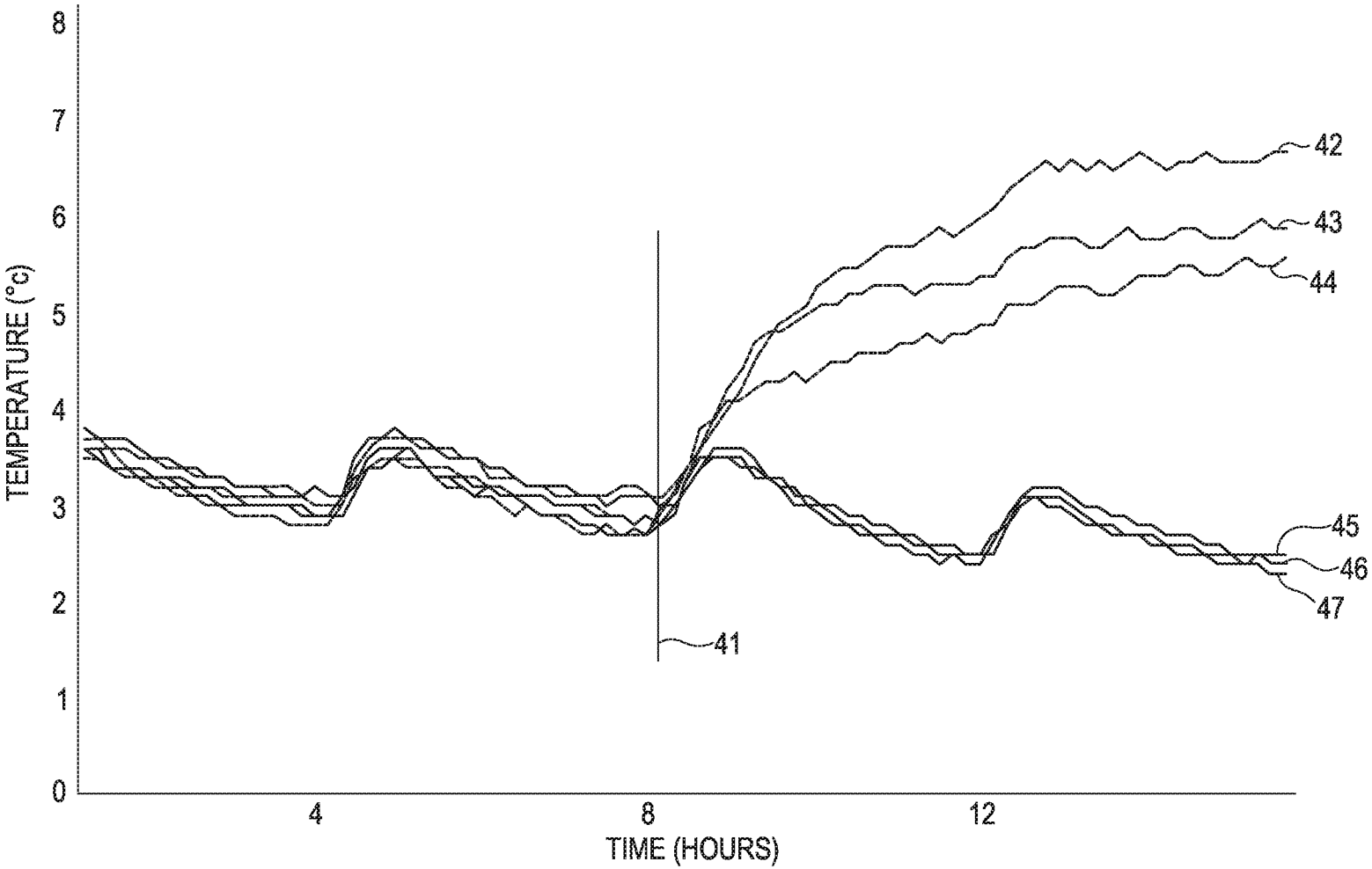
Figure 5:
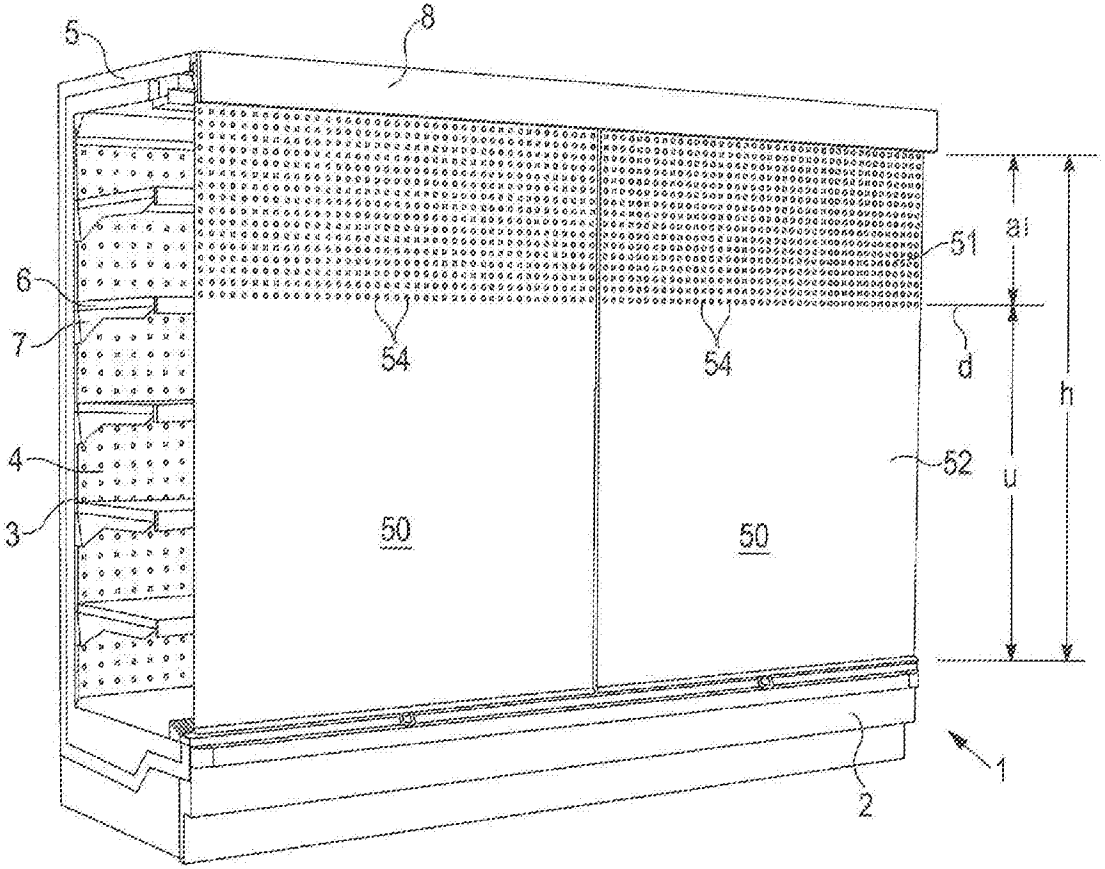
Figure 6:
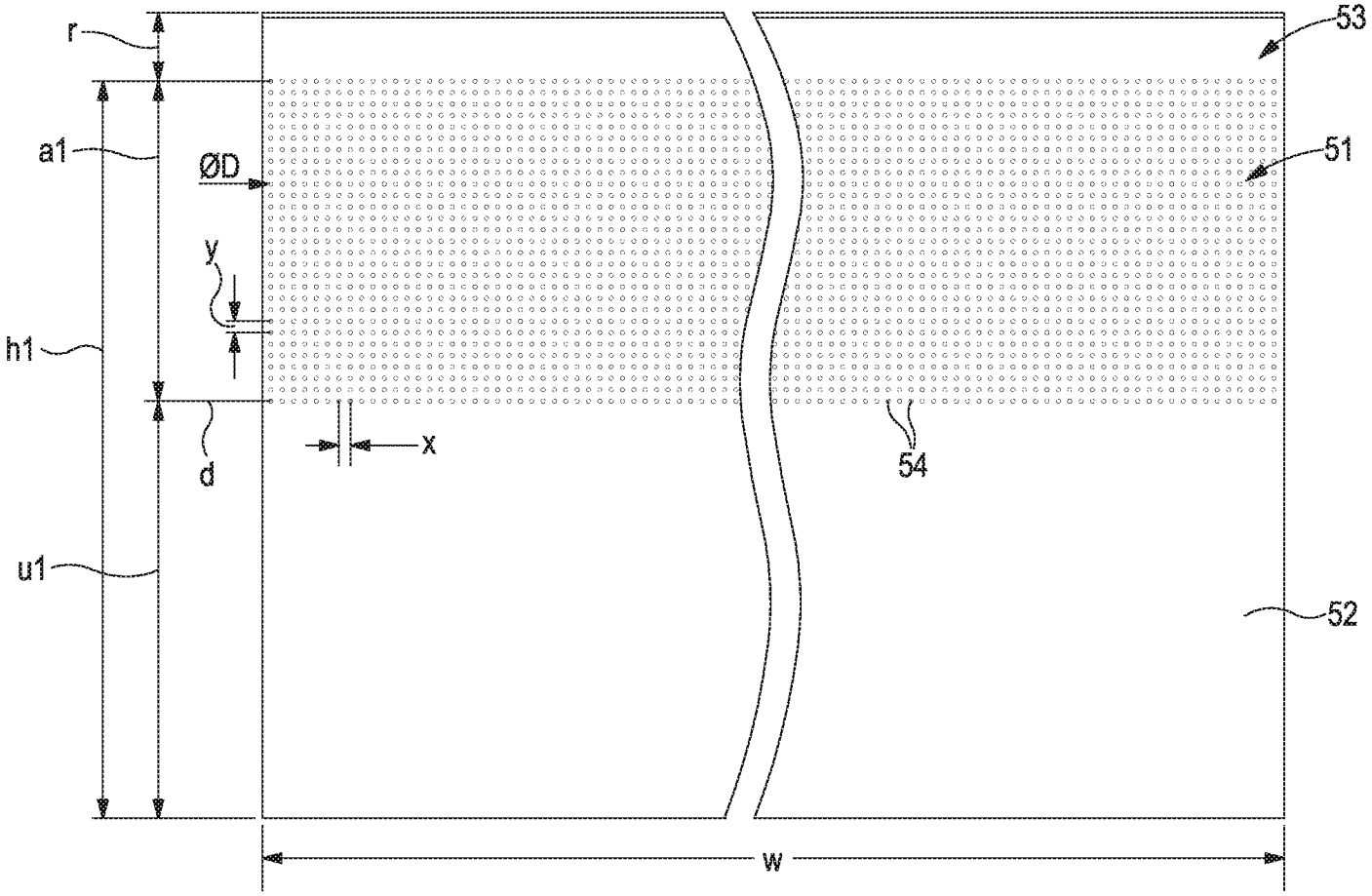
Figure 8:
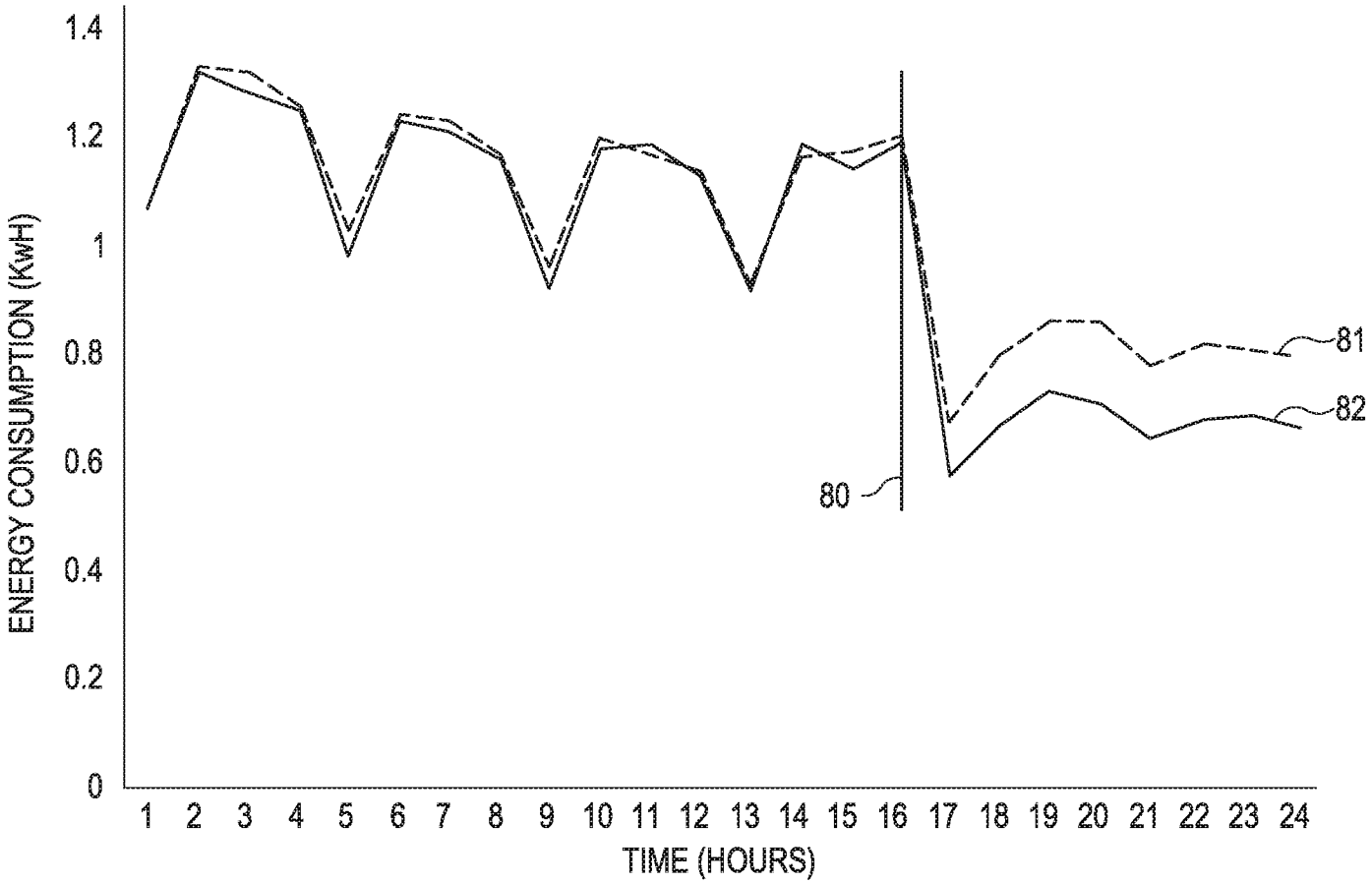
Figure 9:
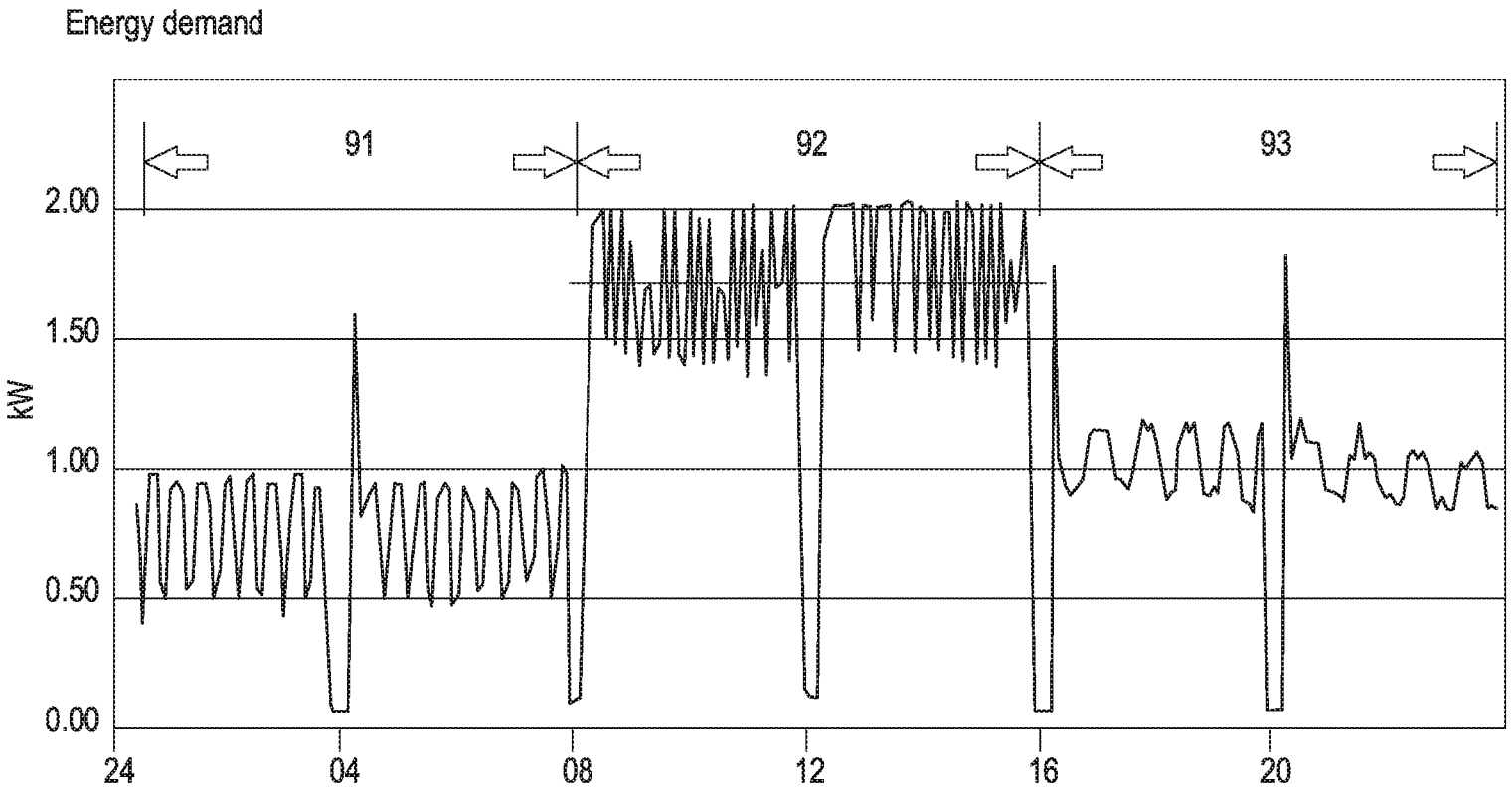

The invention will now be described, by way of example, with reference to the accompanying drawings, in which:

FIG. 1 shows a perspective view of a known refrigeration display case having a known night cover, FIG. 2*a* shows airflow in a known display case when a night blind is not deployed, FIG. 2*b* shows airflow in a known display case when a known night cover is deployed, FIG. 2*c* shows the airflow of a display case having a night cover in accordance with this invention, FIG. 3*a* shows airflow ingress and leakage of a display case with a known night cover, FIG. 3*b* indicates the spread of hotspots in a known display case with a known night cover, FIG. 3*c* shows products affected by hotspots in a known display case having a known night cover, FIG. 4 shows, in graphical form, the effect of hotspots in a known display case having a known night cover, and the reduction in temperature with a night cover in accordance with this invention, FIG. 5 shows a perspective view of a refrigerated display case having a night cover in accordance with this invention, FIG. 6 shows a night cover in accordance with this invention, FIGS. 7*a*-7*d* show the apertured to non-apertured proportions of a night cover in accordance with this invention for different display cases, FIG. 8 shows, in graphical form, the refrigeration system energy improvement with the night cover of this invention, and FIG. 9 shows, in graphical form, the energy demand with no night cover, a known night cover and a night cover in accordance with the invention.

In the Figures like reference numerals denote like parts.

FIG. 1 shows a refrigerated display case 1 having a base 2, side walls 3, a rear wall 4, a top cover 5 and adjustably locatable shelves 6 mounted on brackets 7. In the example shown, there are five shelves, but this number will vary upon the requirements of the merchandiser. Also, in the current example, the side wall is shown as being transparent plastics or glass, but may be metal or, if two display cases are joined together, open.

The display case is provided with a pair of un-perforated night covers 40 which are each mounted on a respective roller 710 (shown in FIGS. 2*a*-2*c*) having a spring biased mechanism against which the covers may be deployed to a position, as shown in FIG. 1, where a handle 11 used for manual deployment and re-deployment is attached by a hook, not shown, to the base 2 so as to maintain the cover in a deployed position. The display case, when the covers are not deployed, has an aperture height h, known as the "throat" height of the display case.

The roller upon which the night cover 10 is wound is secured to the top cover 5 and located behind a valance 8.

FIG. 2*a* shows airflow in a known display case having a riser 9 extending from the base 2. Located beneath the lowermost shelf 6 is a refrigeration system 20 comprising a compressor, condenser, and an evaporator, these items not being separately shown. The display case has an open front 21. The refrigeration system produces cooled air which is blown by a fan (not shown) through a channel 22 at the rear of the display case and through apertures in the rear wall 4 to spread over each of the shelves 6, the flow of cooled air being shown by arrow-headed lines 23. The cooled air travels along the underside of the top cover 5 and it is then directed downwardly as an air curtain 24 to the inner side of the riser 9, whereupon the air re-enters the base to be re-cooled by the refrigeration system 20.

Ambient air 25, shown by arrow-headed broken lines, enters the front of the display case and mixes with, but does not penetrate, the air curtain 24, and a mixture of the cool, heavier, air from the air curtain 24 and the ambient air 25 spills out at the base of the display case over the riser 9.

When the night cover 40 is deployed, as shown in FIGS. 2*b* and 3*a*, it will be understood that because the night cover is not sealed to the display case, so ambient air passes between the upper outer vertical edge of the night cover and the side 4 of the display case and also between a vertical gap between each adjacent night cover 40, as shown by arrow-headed lines 26 in FIG. 3*a*. Because the ambient air is travelling through a relatively narrow gap of approximately 10 mm between the outer vertical edge of the blind and the display case side and a gap of about 20 mm between adjacent edges of the night covers, so a positive air pressure is formed which, as shown by broken arrow-headed lines 27 in FIG. 2*b*, penetrates the air curtain to cause hotspots, as will be described herein with reference to FIG. 3*b*. The ambient air mixed with the air curtain reaches an equilibrium pressure around the centre, height-wise of the display case, and exits around the vertical edges of the night blind through negative pressure and the denser cooled air shown exiting the display case is shown by arrow-headed lines 28 in FIGS. 2*b* and 3*a*.

The effect of the cool air 28 escaping towards the base of the display case results in more warm ambient air being drawn into the gap at the vertical edges of the blind which cause product temperatures to dramatically rise in hotspots.

The formation of hotspots is shown in FIG. 3*b*. A median of the display case throat height is denoted by broken line M, and hotspot areas caused by a conventional night blind, as shown by cross-hatched areas S, increase in width with greater height extending from a point just below the median M. The effect of these hotspots upon products on the shelves within the display case is shown in FIG. 3*c*, where product 50 is shown stacked on each of the shelves 6 and base 2 and the products 51 affected by the hotspots are shown to increase laterally of the display case with height with the possibility that products in the hotspots may exceed a desired temperature for life expectancy.

The effect of the known night cover upon temperature within the display case is graphically shown in FIG. 4, which has temperature in degrees C. as an ordinate and an abscissa of time in hours. The time at which the night cover is lowered is indicated by line 41 and the graphical representations are temperatures measured at the second shelf down from the top. Broken line 42 is the temperature measured by a heat probe located at the centre of shelf 2, i.e. between the two adjacent blinds 40;. Broken line 43 is the temperature measured by a heat probe located at the left hand side of shelf 2. Broken line 44 shows the temperature measured by a heat probe on the shelf 2 at the right hand side of shelf 2; changes in temperature over a sixteen-hour period are recorded.

Referring to FIG. 5, a pair of night covers 50 in accordance with this invention are shown mounted over the open front of a display case 1. The open front of the display case has height h and the night cover of this invention has an uppermost apertured section 51 extending the width of each night cover and to a depth a1 from the top of the case opening to a distance d, and a section 52 without apertures extending from d to the lowermost part of the opening at the base of a distance u.

A top plan view of the night cover, before it is wound on a roller, is shown in FIG. 6. In its unwound state from the top of the apertured section 51 to the lowermost end of the night cover is height h1. The length al of the apertured section 51 is in the range 30%-40% of h1, in dependence upon the height of a display case and the size of the front opening of the display case, as will be described later herein with reference to FIG. 7. The distance from distance d of the section 52 without apertures to the lowermost end of the night cover is u1. In general, distance al, in a preferred embodiment, is one third h1, and distance u1 is two thirds h1.

An unapertured section 53 above the apertured section 51 is provided for securement about the roller and the section 53 is denoted by length r which has a length, typically, 0.1 of h1, i.e. approximately 10% of h1. In practice, however, in dependence upon the size of the display case, a portion of the section 51 may also be wrapped around the roller 710.

The night cover has a width w.

In one exemplary embodiment, length r is 150 mm, length a is 870 mm, distance u1 is 1,100 mm so that h1 is 1,970 mm. The lowermost 20 mm of section 53 of the night cover is turned back on itself to form an envelope within which may be located a stiffening strip which, in one embodiment, is a magnetic strip for securing the night cover when deployed to a base of the refrigerated case.

The apertures 54 are each circular holes which have a constant hole diameter D in the chosen to be in the range 9 mm-11 mm and, preferably, 10 mm The apertures are in a grid and have a hole centre spacing in the vertical direction y of 3D. The spacing between hole centres in the horizontal direction x is in the range 2D to 4D, preferably 3D.

By way of example, for a one metre wide night cover the percentage of aperture area to unapertured area ranges between 2.6% for a 450 mm high night cover to 4.2% for a 870 mm high night cover, so there is very little wasted material.

The distances x and y and the hole diameter D are particularly chosen so as not to weaken the night cover and to provide a cover avoiding hotspots. Similarly, the ratio of the apertured section 51 to the section 52 without apertures is particularly chosen to provide non-turbulent airflow and to accomplish the avoidance of hotspots. Thus, the dimensions are a particular selection of dimensions.

FIG. 2*c* shows the night cover of this invention deployed with the ingress of ambient air shown by broken lines 29 evenly spread through the apertured section 51, lowering the air velocity so it does not penetrate the air curtain and exiting near the base 2.

FIG. 7 shows various height sizes of display case in which FIG. 7*a* shows a display case having a height of 2 m and the apertured section 51 is 540 mm and the unapertured section 52 is 1,080 mm, giving a one third to two thirds ratio of apertured to non-apertured sections.

FIG. 7*b* shows another display case having a height of 2 m, but with a front riser 9. In this example, the apertured section 51 has a height of 450 mm and the section 52 without apertures has a height of 1,080 mm, giving a ratio of 30%-70% apertured to non-apertured sections.

FIG. 7*c* shows a display case having a height of 2.2 m with no riser and the apertured portion extends a distance of 735 mm and the section 52 without apertures extends a distance of 1,080 mm, providing a ratio of apertured to non-apertured sections of about 40% to 60%.

FIG. 7*d* shows another display case having a height of 2.2 m with a riser 9. In this example, the apertured section 51 extends a distance of 630 mm and the non-apertured section 52 extends a distance of 1,080 mm, giving a ratio of apertured to non-apertured of approximately one third to two thirds.

Referring again to FIG. 4, with a night cover in accordance with this invention a heat probe mounted at the centre of shelf 2 at the gap between adjacent night covers 50 recorded a curve as shown by line 47, a heat probe at the left hand side of the night cover recorded a temperature shown by curve 45, and a probe at the right hand side of the night cover recorded a temperature as shown by curve 46. From a comparison of curves 42 and 47, between curves 43 and 45, and between curves 44 and 46, it will be seen that a significant drop in temperature occurred with the night cover of this invention versus the known night cover.

FIG. 8 shows curves of the energy drawn by the refrigeration system. The cycle is over a period of twenty four hours, with the night cover not deployed for sixteen hours and deployed for eight hours, the time at which the night cover was lowered being denoted by line 80. The power consumption is shown as the ordinate in kWh and the abscissa is time in hours. The known night cover power consumption is denoted by broken line 81 and the power consumption of the present invention is denoted by solid line 82. The power peaks and troughs with the night cover raised is caused by the refrigerator system cycling. It will be noted that with the night cover lowered, the energy consumption shows a difference of approximately 10% improvement.

The energy demand of the refrigeration system in various circumstances is shown in FIG. 9. The curves shown in FIG. 9 have an ordinate in kW and the abscissa is time in hours. The energy curve of the present invention is shown in section 91, the energy demand without a night cover is shown in section 92, and the energy demand with a known non-apertured night cover is shown in section 93. From these curves, the energy demand of the present invention versus a known night cover is seen to have a mean improvement of 0.25 kW.

Thus, after several years experimentation, the present inventor has found that a particular aperture shape and size having a particular pitch in the x and y direction and spaced over a particularly defined portion of a night cover regulates and evenly diffuses air ingress to eliminate night hotspots and improve energy demand The elimination of hotspots serves to improve product, e.g. food safety, and eliminate wastage through the temperature of product in a case rising unallowably. Further, by virtue of carefully balancing air ingress into the case when a night cover is deployed, so energy consumption is reduced, making a contribution to the reduction of global warming.

Thus, the invention, has apertures which are particularly sized and spaced to permit ambient air to flow therethrough to substantially prevent hotspots occurring in the refrigerator display case and which compensate for air lost from the refrigerated display case without breaking through the air curtain in the display case.

The night cover of this invention has the further advantages that:

It does not require extra parts and so may be readily retro-fitted to all case types.

It is inexpensive to produce.

It requires no changes to existing cases.

It requires no extra staff training.

I claim:

1. A refrigerated display case (1) having a front opening and a roller supporting a night cover (50) comprised of two sections only, the two sections consisting of an upper first section and a lower second section, the night cover formed of flexible material having a height h1, said night cover being arranged to be in a non-deployed position when the refrigeration display case front opening is to be substantially open, and when in a deployed position said night cover is arranged to substantially close said front opening, said flexible material including apertures (54) therein arranged in said upper first section (51), said upper first section having a range of heights al which is 30%-40% of said height h1, all of said apertures having the same diameter D arranged to be a fixed dimension chosen to be in the range 9 mm-11 mm and being arranged in a vertical and a horizontal grid, the spacing between said aperture centres in the vertical direction of said grid being 3D and the spacing between aperture centres in the horizontal direction of said grid being in the range 2D to 4D, and the remaining lower second section (52) of said cover being without apertures.

2. A refrigerated display case as claimed in claim 1, wherein the diameter D of the apertures is 10 mm.

3. A refrigerated display case as claimed in claim 1, wherein the spacing of the aperture centres in the horizontal direction of said grid is 3D.

4. A refrigerated display case as claimed in claim 1, wherein in a manual version of the night cover, the lowermost end thereof is attached to a handle (11) for deploying the night cover.

5. A refrigerated display case as claimed in claim 4, wherein said handle has a hook for securing the night cover to a base of the refrigerated display case.

6. A refrigerated display case as claimed in claim 1, wherein the lowermost end of the night cover forms an envelope within which is located a magnetic strip for securing the night cover when deployed to a base of the refrigerated case.

7. A refrigerated display case as claimed in claim 1, wherein the roller is electrically operated to deploy and rewind the night cover.

8. A night cover (50) for covering an opening in a front of a refrigerated display case, said night cover comprised of two sections only, the two sections consisting of an upper first section and a lower second section, the night cover being made from a flexible material having a height h1, the flexible material including apertures arranged in a vertical and horizontal grid in the upper first section (51), and the lower second section (52) which is without apertures, said upper first section having a range of heights a1 which is 30%-40% of said height h1, all of said apertures having the same diameter D arranged to be a fixed dimension chosen to be in the range 9 mm-11 mm, the spacing between said aperture centres in the vertical direction of said grid being 3D, and the spacing between aperture centres in the horizontal direction of said grid being chosen to be in the range 2D to 4D.

9. A night cover as claimed in claim 8, wherein height a is one of one third of h1, 30% of h1, 40% of h1 and 37% of h1.

10. A night cover as claimed in claim 8, wherein for a one metre wide night cover the percentage of aperture area to unapertured area ranges between 2.6% for a 450 mm high night cover to 4.2% for a 870 mm high night cover.

11. A refrigerated display case including a night cover (50) for covering a front opening of the refrigerated display case, the night cover (50) comprised of two sections only, the two sections consisting of an upper first section and a lower second section, the night cover comprising a flexible material having a height h1, said night cover being arranged to be in a non-deployed position when the front opening of the display case is to be substantially open, and when in a deployed position said night cover is arranged to substantially close said front opening, a portion of a surface area of the flexible material defining an area without apertures, and said night cover including apertures (54) therein arranged in the upper first section (51), said upper first section having a range of heights a1 which is 30%-40% of said height h1, an area of the apertures defining an apertured area;

said portion being the lower second section (52) without apertures; and wherein, in use, the night cover is configured such that the percentage of the apertured area to the unapertured area within the front opening of the display case is arranged to incrementally increase and does not decrease while the night cover is moved from the non-deployed position to the deployed position.

12. A refrigerated display case as claimed in claim 11, wherein each of said apertures has a diameter D chosen to be the same dimension which is in the range 9 mm-11 mm and being arranged in a vertical and a horizontal grid, the spacing between said aperture centres in the vertical direction of said grid being 3D and the spacing between aperture centres in the horizontal direction of said grid being in the range 2D to 4D.

13. A refrigerated display case as claimed in claim 12, wherein the diameter D of the apertures is 10 mm.

14. A refrigerated display case as claimed in claim 12, wherein the spacing of the aperture centres in the horizontal direction of said grid is 3D.

15. A refrigerated display case as claimed in claim 12, wherein height al is one of one third of h1, 30% of h1, 40% of h1 and 37% of h1.

16. A refrigerated display case as claimed in claim 12, wherein for a one metre wide night cover the percentage of apertured area to unapertured area ranges between 2.6% for a 450 mm high night cover to 4.2% for a 870 mm high night cover.

* * * * *